US006308410B1

(12) United States Patent
Sabathie

(10) Patent No.: US 6,308,410 B1
(45) Date of Patent: Oct. 30, 2001

(54) METHOD FOR FIXING TRANSVERSE PARTITIONS IN THE TUBULAR FLUID BOX OF A HEAT EXCHANGER

(75) Inventor: Pierre Sabathie, Maurepas (FR)

(73) Assignee: Valeo Thermique Moteur, La Verriere (FR)

( * ) Notice: Subject to any disclaimer, the term of this patent is extended or adjusted under 35 U.S.C. 154(b) by 592 days.

(21) Appl. No.: 08/793,242

(22) PCT Filed: Jun. 19, 1996

(86) PCT No.: PCT/FR96/00949

§ 371 Date: Feb. 21, 1997

§ 102(e) Date: Feb. 21, 1997

(87) PCT Pub. No.: WO97/01073

PCT Pub. Date: Jan. 9, 1997

(30) Foreign Application Priority Data

Jun. 23, 1995 (FR) ..... 95 07600

(51) Int. Cl.[7] ..... B23P 15/26; F28F 9/22

(52) U.S. Cl. ..... 29/890.052; 29/890.043; 165/173; 165/174

(58) Field of Search ..... 165/173–176, 165/153; 29/890.052, 890.043

(56) References Cited

U.S. PATENT DOCUMENTS

| | | | | |
|---|---|---|---|---|
| 5,097,900 | * | 3/1992 | Yamaguchi | 165/174 |
| 5,119,552 | * | 6/1992 | Sutou et al. | 29/890.052 |
| 5,233,756 | | 8/1993 | Le Gauyer | 29/890.043 |
| 5,586,600 | * | 12/1996 | Cribari | 165/173 |

FOREIGN PATENT DOCUMENTS 501444 2/1992 (EP) .

* cited by examiner

*Primary Examiner*—Leonard Leo
(74) *Attorney, Agent, or Firm*—Morgan & Finnegan, LLP

(57) ABSTRACT

The partitions are inserted through an open end of the cylindrical tubular wall of the fluid box, positioned and immobilised by means of deformations in the tubular wall, before the tubes are inserted and the assembly is soldered in a fluidtight manner. According to the invention, the deformations are localised on the outside of the region of the perimeter of the tubular wall on which the passage openings for the tubes extend, so as not to affect these openings. The method may be used in a condenser for a motor vehicle air conditioning unit.

8 Claims, 1 Drawing Sheet

Figure 1:
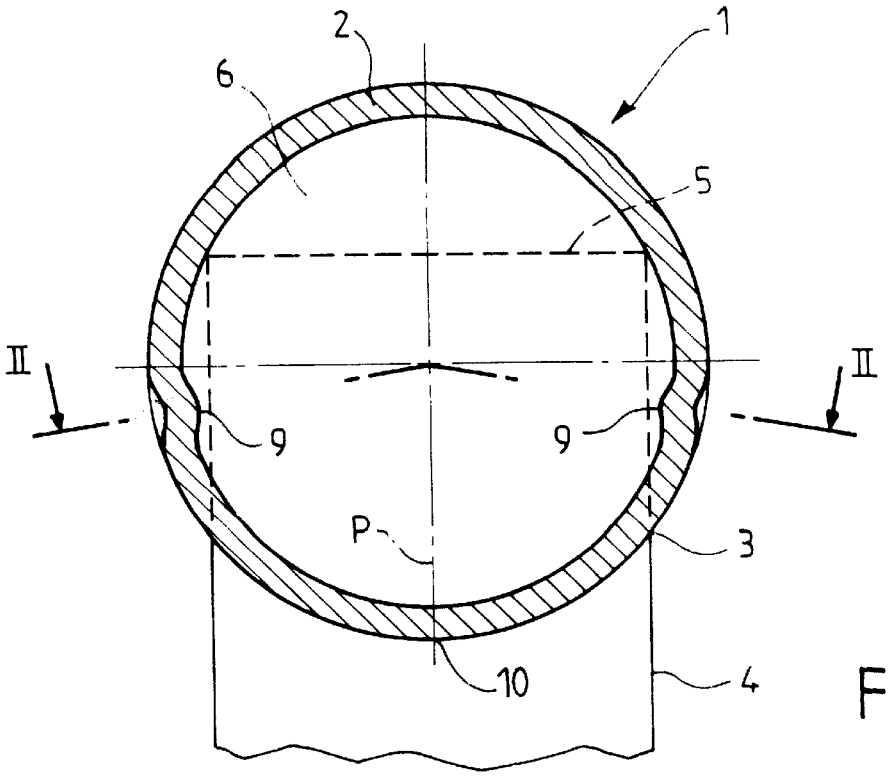

METHOD FOR FIXING TRANSVERSE PARTITIONS IN THE TUBULAR FLUID BOX OF A HEAT EXCHANGER

The invention concerns a method for producing a heat exchanger comprising at least one fluid box delimited by a tubular wall and separated into compartments by at least one intermediate transverse partition, and a multiplicity of parallel tubes, each communicating with a compartment of the fluid box through an opening in the tubular wall, a method in which each partition is inserted into the tubular wall, through an open end thereof, in order to bring it to the position which it is to occupy, and the partition is immobilised by deformation of the tubular wall on each side thereof.

Such a method is described in FR-A-2 676 535. In this known method, the deformation of the tubular wall is produced in the form of beads extending continuously over the entire circumference thereof and consequently in particular in the of the perimeter in which the passage openings for the tubes are formed. It has been found that, when these openings produced before the beading, the latter gives rise to a deformation of the openings which may lead to difficulty in connecting the tubes to the fluid box and/or to sealing defects.

The invention relates notably to a method of the type defined in the introduction, and provides that the deformation is produced solely in at least one region of the perimeter of the tubular wall distinct from the one in which the openings are formed.

Surprisingly, limiting the deformation to one or more restricted regions of the perimeter does not impair the correct positioning of the partitions.

Optional characteristics of the invention, complementary or alternative, are set out below:

The deformation is produced in two regions of the perimeter disposed approximately symmetrically with each other with respect to an axial plane of the tubular wall passing through the centers of the openings.

The two regions are approximately diametrically opposed.

The deformations are practically localised at one point in the circumferential direction.

The ends of the tubular wall are closed off by transverse end partitions, the immobilization by deformation of the tubular wall being achieved both for the end partitions and for the intermediate partitions.

In order to deform the tubular wall, the latter is pressed in towards the inside of the fluid box.

The openings are produced before the transverse partitions are positioned and immobilized by deformation.

The tubular wall is soldered to the partition and/or to the tubes in a fluid tight manner.

The tubular wall is formed by a rolled sheet, two opposite edges of which are connected along a generating line of the wall.

The invention also has as its object a heat exchanger such as can be obtained by the method defined above, comprising at least one fluid box separated into compartments by at least one transverse partition, and a multiplicity of parallel tubes, each communicating with a compartment of the fluid box through an opening therein, the fluid box having a tubular wall through which the openings pass and which surrounds the edge of the partition, and deformed on each side thereof in order to immobilize it, in at least one region of its perimeter distinct from that in which the openings are formed.

Figure 2:
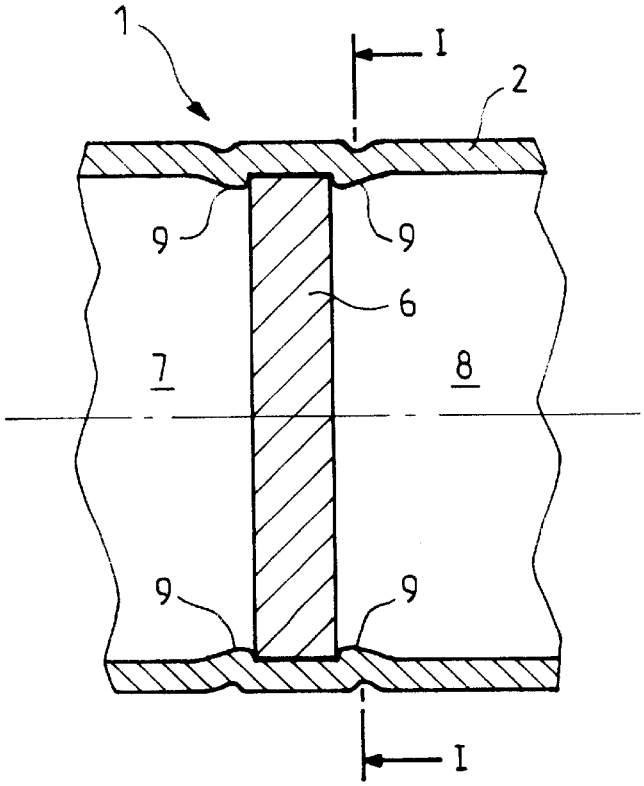

The characteristics and advantages of the invention will be disclosed in more detail in the following description, with reference to the accompanying drawings, in which:

FIG. 1 is a partial view of a heat exchanger according to the invention, in a section transverse to the axis of the tubular wall, along the line II—II in FIG. 2; and FIG. 2 is a partial view in axial section along the line II—II in FIG. 1.

The heat exchanger, partially illustrated, designed notably to serve as a condenser in an air conditioning installation for the passenger compartment of a motor vehicle, is of the type described in FR-A-2 676 535 and comprises a fluid box 1, the tubular wall 2 of which has a multiplicity of openings 3. In each of these a tube 4 is engaged, the transverse section of which is elongate in the transverse direction of the fluid box, the tubes 4 being parallel to each other and perpendicular to the longitudinal direction of the fluid box. One end 5 of each of the tubes 4 is situated inside the fluid box 1, whilst the opposite end can be situated inside another fluid box, not shown, and similar to the fluid box 1 and extending parallel thereto. Inserts, not shown, consisting of strips of sheet metal curved in sinusoidal shape, are placed in the gaps between the tubes 4 so as to come into thermal contact therewith.

Partitions 6 extend transversely inside the fluid box, namely at least one intermediate partition, and where necessary end partitions. Only an intermediate partition 6 is visible in FIG. 2, and separates two compartments 7 and 8 of the fluid box. Each of the partitions 6 is immobilized in position by projections or deformations 9 on the tubular wall 2. In the example illustrated, four deformations 9 are provided, projecting towards the inside of the fluid box, for the same partition 6, two of which are on the same side as the compartment 7 and two on the same side as the compartment 8. As can be seen in FIG. 1, each deformation 9 is located at substantially one point in the circumferential direction of the tubular wall, in that it has a profile in the shape of a bell extending over a short length of arc. On each side of the partition 6, the two deformations 9 are disposed symmetrically with each other with respect to the axial plane of the tubular box passing through the centers 10 of the openings 3, and are separated from each other by approximately a half-circumference.

The peripheral edge of the partition 6 is soldered in a fluid tight manner to the internal surface of the tubular wall 2, and the external surface of the tubes 4 is soldered in a fluid tight manner to the edges of the openings 3.

To produce the heat exchanger, the starting point is a tubular wall 2 of cylindrical shape, having a uniform internal transverse section which is substantially circular and sufficiently large to allow the longitudinal sliding of the partition 6, the contour of which is also circular. The tubular wall 2 can consist of a rolled sheet assembled, notably welded, edge to edge. Each of the partitions is inserted through one of the open ends of the tubular wall and is caused to slide longitudinally as far as the position which it is to occupy. The deformations 9 are then produced, which immobilise the partitions in position. These deformations can be obtained by means of a tool bearing on the external face of the wall 2.

The ends 5 of the tubes 4, which come into abutment against the internal surface of the tubular wall 2, as shown in FIG. 1, are then inserted into the fluid box 1 through the openings 3. Contrary to that which is described in the aforementioned document, the openings 3 were here produced before the deformations 9, and without the formation of craters towards the inside of the fluid box. Consequently the region of the perimeter of the tubular wall on which the openings 3 extend has a profile in the shape of an arc of a circle over the entire length of the wall 2.

Fluid tightness between the external surface of the tubes 4 and the openings 3 on the one hand, and between the edge of the partition 6 and the internal surface of the tubular wall 2 on the other hand, is obtained by soldering using a fusible metallic coating which is caused to melt by heating the assembled heat exchanger. This coating is preferably provided on the external surface of the tubular wall 2 in order to connect it with the tubes, and on the partitions to connect them with the tubular wall. The presence of such a coating on the internal surface of the tubular wall, which might cause a partial blocking of the ends of the tubes, is avoided.

What is claimed is:

1. A method for producing a heat exchanger having at least one fluid box delimited by a tubular wall of generally cylindrical shape having a substantially uniform circular internal transverse section and having a perimeter and a pair of end portions, said fluid box being separated into compartments by at least one intermediate transverse partition, having a generally circular edge portion, said edge portion matching said tubular wall circular internal transverse section for sliding movement of said partition therewithin, each of said fluid box compartments having a respective opening formed therein, the heat exchanger further having a plurality of parallel tubes, each tube communicating with a compartment of the fluid box through said respective opening formed in said fluid box in a region of the perimeter of said tubular wall, comprising the steps of:

inserting each partition into the tubular wall through an open end of said wall to locate the partition in a desired position;

immobilizing each partition by deforming the tubular wall to establish two regions of the perimeter of the tubular wall distinct from the regions in which said openings are formed, said established two regions being disposed approximately symmetrically with each other with respect to an axial plane passing through said openings; and forming said fluid box compartment respective openings before the transverse partitions are positioned and immobilized by deformation.

2. A method according to claim 1 wherein said established two regions are approximately diametrically opposed.

3. A method according to claim 1, wherein said deforming is practically localised at one point in the circumferential direction.

4. A method according to claim 1, wherein the end portions of the tubular wall are closed off by transverse end partitions which are immobilized by deforming regions of the perimeter of the tubular wall.

5. A method according to claim 1, wherein in order to deform the tubular wall, said wall is pressed in towards the inside of the fluid box.

6. A method according to claim 5, wherein the tubular wall is soldered to the partition and/or to the tubes in a fluidtight manner.

7. A method according to claim 1, wherein the tubular wall is soldered to each partition and/or to the tubes in a fluidtight manner.

8. A method according to claim 1, wherein the tubular wall is formed by a rolled sheet, two opposite edges of which are connected along a generating line of the wall.

* * * * *